US006242871B1

(12) United States Patent
Ge

(10) Patent No.: US 6,242,871 B1
(45) Date of Patent: Jun. 5, 2001

(54) HIGH FIELD EFFECT NEON LAMP

(76) Inventor: Rui Ihu Ge, P.O. Box 82-144, Taipei (TW)

( * ) Notice: Subject to any disclaimer, the term of this patent is extended or adjusted under 35 U.S.C. 154(b) by 0 days.

(21) Appl. No.: 09/076,480

(22) Filed: May 12, 1998

(51) Int. Cl.[7] ..... G05F 1/00

(52) U.S. Cl. ..... 315/291; 315/307; 315/185.5; 362/263; 362/265

(58) Field of Search ..... 315/307, 291, 315/DIG. 2, DIG. 5, DIG. 7, 134, 282, 185.5; 362/217, 263, 265, 276; 363/23, 93, 97, 133; 313/479

(56) References Cited

U.S. PATENT DOCUMENTS 4,667,132 * 5/1987 Leale ..... 315/282
4,734,828 * 3/1988 Vargo ..... 363/22
5,336,976 * 8/1994 Webb et al. ..... 315/134
5,702,179 * 12/1997 Sidwell et al. ..... 362/255

* cited by examiner

*Primary Examiner*—Haissa Philogene
(74) *Attorney, Agent, or Firm*—A & J

(57) ABSTRACT

A low pollution, low energy consumption, high field effect neon lamp with scanning point selectable, the neon lamp includes a glass tube having at least one section of the outside wall thereof coated with a transparent conductive layer, a pulse width modulation and scanning control circuit connected to the transparent conductive layer, the pulse width modulation and scanning control circuit being controlled to give a high frequency high voltage pulse width variable pulse signal to the transparent conductive coating layer, causing a linearity-variable static electric field to be produced in the glass tube, so that an inert gas in the glass tube is ionized to strike a fluorescent material on the inside wall of the glass tube, causing it to emit light.

3 Claims, 5 Drawing Sheets

HIGH FIELD EFFECT NEON LAMP

BACKGROUND OF THE INVENTION

1. Field of the Invention

The present invention relates to neon lamps, and more particularly to a high field effect neon lamp which consumes less energy, produces low noise, and can be controlled to start scanning from any desired point. The neon lamp uses a pulse width modulated weak signal to control the scanning function. The design is capable of scanning a neon lamp tube of big diameter.

2. Description of the Prior Art

A regular neon lamp is equipped with positive and negative electrodes, and used with a ferromagnetic transformer of about 450 W or electronic transformer of about 100~160 W. This structure of neon lamp consumes much energy. During the operation of the neon lamp, the high voltage transformer produces high noise. When a high voltage is provided to the high voltage electrodes, electric discharge takes place through an inert gas in the glass tube of the neon lamp, thereby causing a fluorescent material to be stricken. Because this structure of neon lamp works with a high voltage, it is not safe for use indoors. Furthermore, because of the installation limitation of the high voltage electrodes, the scanning of the neon lamp must be started from one end (for cost's sake, it is not practical to install the high voltage electrodes at the center area of the glass tube.

SUMMARY OF THE INVENTION

The present invention relates to neon lamps, and more particularly to a high field effect neon lamp which consumes less energy, produces low noise, and can be controlled to start scanning from any desired point. The neon lamp uses a pulse width modulated weak signal to control the scanning function. The design is capable of scanning a neon lamp tube of big diameter.

The present invention has been accomplished to provide a high field effect neon lamp which eliminates the aforesaid problems. It is one object of the present invention to provide a high field effect neon lamp which consumes less electric energy, and produces low noise. It is another object of the present invention to provide a high field effect neon lamp which can be made to start scanning from any desired point at the glass tube. It is still another object of the present invention to provide a high field effect neon lamp which is safe in use. According to the present invention, a pulse width modulation and scanning control circuit is provided and controlled to give a high frequency high voltage pulse width variable pulse signal to a transparent conductive coating layer, which is coated on desired area(s) at the outside wall of the glass tube of the neon lamp, causing a linearity-variable static electric field to be produced in the glass tube, so that an inert gas in the glass tube is ionized to strike a fluorescent material on the inside wall of the glass tube, causing it to emit light.

DETAILED DESCRIPTION OF THE PREFERRED EMBODIMENT

Figure 1B:
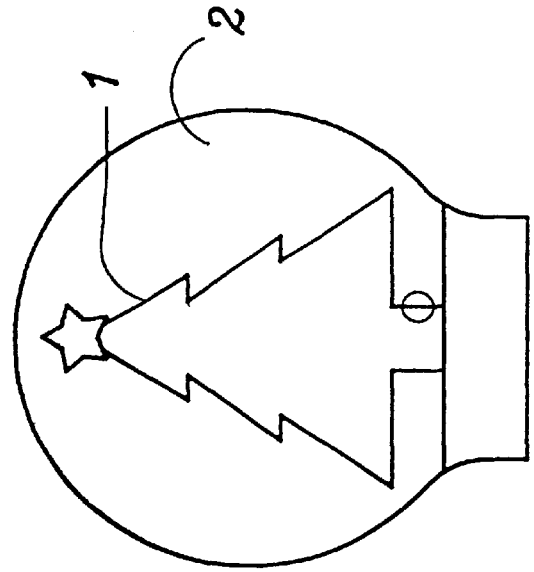
FIG. 1B shows another application example of the present invention where the neon lamp is made in the form of a Christmas tree and covered within a shade.
Figure 1A:
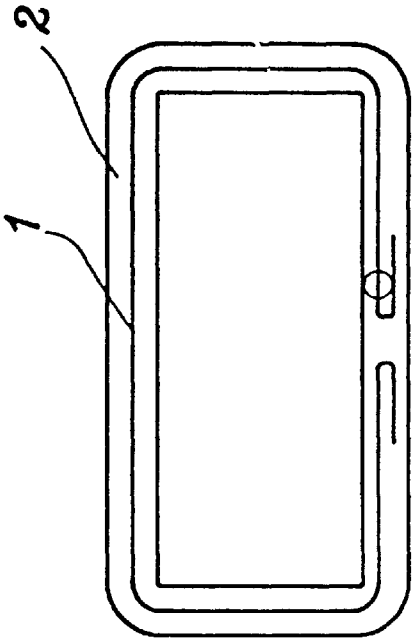
FIG. 1A shows an application example of the present invention where the neon lamp is mounted on a car number plate holder frame and protected by a shade.
Figure 1:
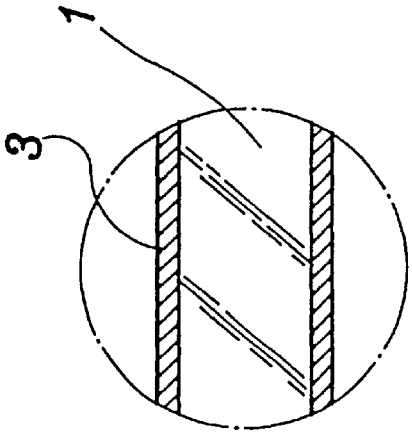
FIG. 1 is a cross sectional view of a neon lamp tube showing a transparent conductive layer covered on the outside wall of the glass tube according to the present invention.

Referring to FIGS. 1, 1A and 1B, the outside wall of the glass tube 1 for a neon lamp in accordance with the present invention is coated with a layer of transparent conductive coating (for example, stannic peroxide) 3. The glass tube 1 is preferably molded from rigid tungsten glass for the advantages of high machinery strength, high melting point, high plasticity, and high durability. After the glass tube 1 has been molded subject to the desired pattern, it is put in an oven and heated to a predetermined temperature, and then a prepared stannic chloride solution is blown into the oven, enabling a uniform spray of stannic chloride solution to be adhered to the outside wall of the glass tube 1, and therefore a transparent conductive layer 3 is permanently covered on the outside wall of the glass tube 1 after an oxidation reduction reaction. The effective covering area of the transparent conductive layer 3 on the glass tube 1 is determined subject to the desired function. For example, when an area of about 10–20 mm long at the geometric center of the glass tube 1 is shielded from coating and maintained in blank and electrical wires are adhered to opposite ends of the transparent conductive layer 3 by a conductive glue, thus a neon lamp tube is obtained in which scanning is achieved from the center area of the lamp tube toward its both ends (the electric circuit will be described further). The neon lamp which is mounted on a car number plate holder frame is an example of this design. The initial scanning point can be at any desired point, or multiple initial scanning points can be set as desired. When the glass tube 1 is processed into a vacuum state, a certain amount of an inert gas and a small amount of mercury are filled in the glass tube 1, and then a scan circuit is connected to the glass tube 1, and a uniform scanning effect from the geometric center of the pattern (of the glass tube) toward opposite ends is thus achieved. If the transparent conductive layer 3 on the glass tube 1 is separated into several separated sections, a low radiation voltage normal lighting lamp is thus obtained. Changing the effective area of the transparent conductive layer 3 simultaneously changes the impedance of the lamp tube, thereby causing the light emitting point of the circuit to be relatively changed. FIGS. 1A and 1B show two neon lamps constructed according to the present invention. The neon lamp shown in FIG. 1A is mounted on a car number plate holder frame around a car number plate. The neon lamp shown in FIG. 1B is made to show the pattern of a Christmas tree. Furthermore, a plastic shade or transparent silicon rubber shade 2 is provided and covered around the glass tube to protect the transparent conductive layer of the neon lamp.

Figure 2:
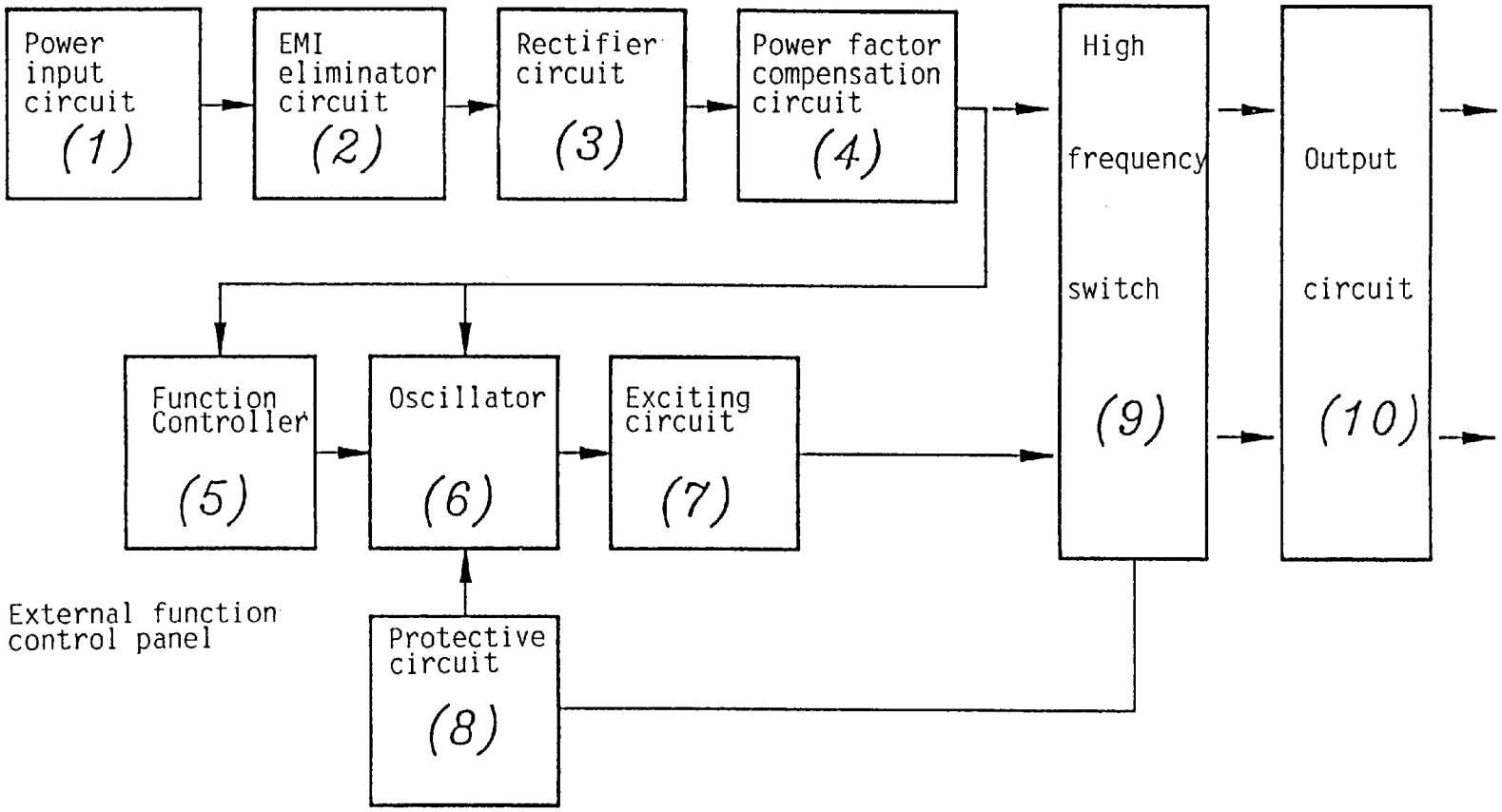
FIG. 2 is a circuit block diagram of a neon lamp control circuit according to the present invention.
Figure 3:
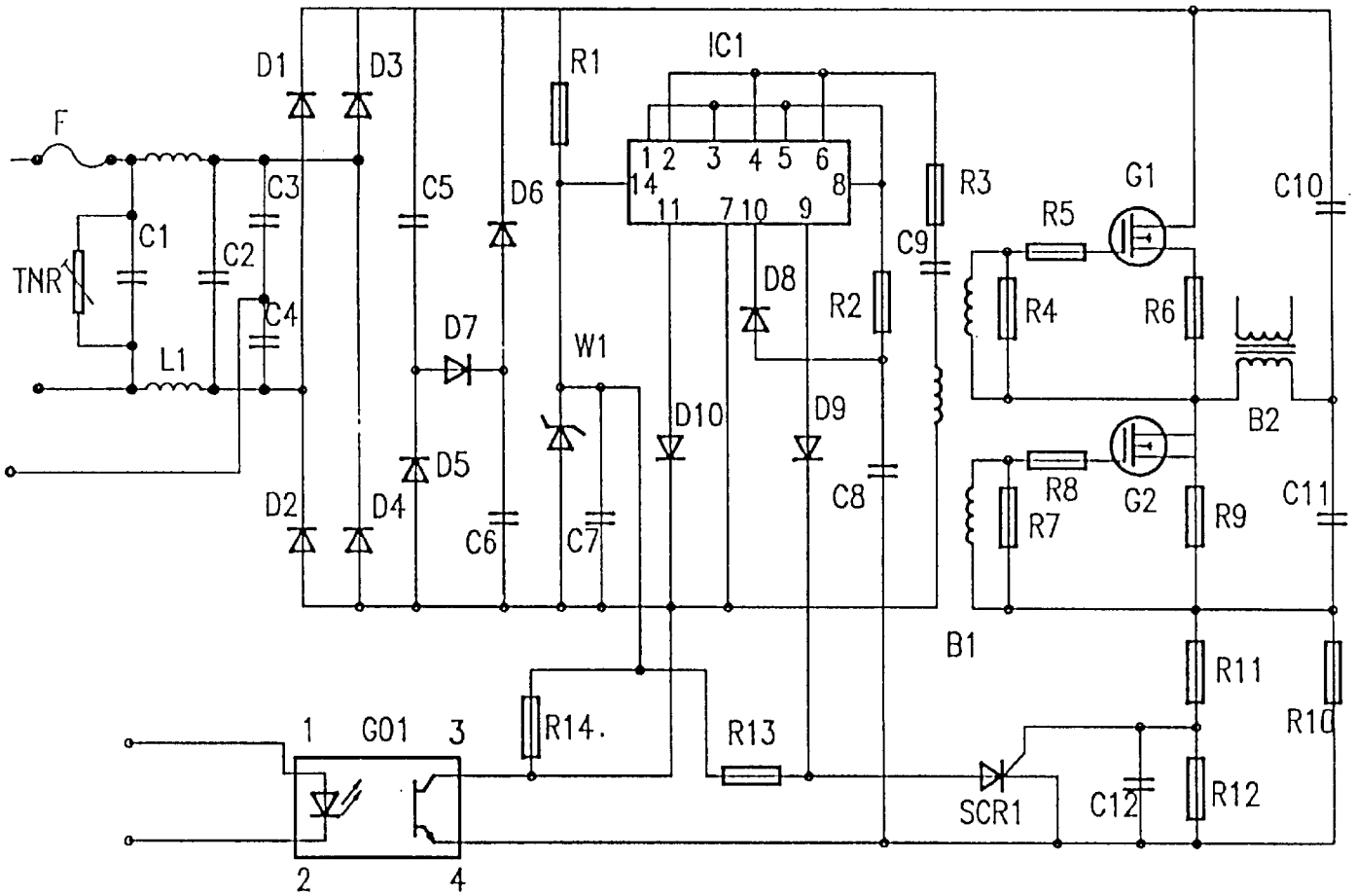
FIG. 3 is a circuit diagram of the neon lamp control circuit shown in FIG. 2.

A neon lamp control circuit in accordance with the present invention, as shown in FIGS. 2 and 3 (FIG. 2 is a circuit block diagram of the neon lamp control circuit; FIG. 3 is a detailed circuit diagram of the neon lamp control circuit) is generally comprised of a power input circuit 1, a EMI (electromagnetic interference) eliminator circuit 2, a rectifier circuit 3, a power factor compensation circuit 4, a function controller 5, an oscillator 6, an exiting circuit 7, a protective circuit 8, a high frequency switch 9, and an output circuit 10. The power input circuit 1 is comprised of fuse means and pressure sensitive resistor means (TNR), and operated to inhibit surge voltage and surge current. The fuse means of the input protection circuit 1 is broken to cut off power supply when the circuit is abnormal. The EMI eliminator circuit 2 is comprised of L1;C1;C2;C3;C4, and operated to eliminate noises. The rectifier circuit 3 is a bridge rectifier comprised D1~D4, and operated to rectify AC power supply into DC power supply. The power factor compensation circuit 4 is a non-source power factor compensation circuit comprised of C5;C6;D6;D7. The power factor of the power factor compensation circuit 4 is over 0.9. The function control circuit 5 is comprised of IC1;G01;R14;D8 and an external control panel, and used for controlling the working status of the oscillator 6 by means of a photoelectric coupling method. The photoelectric coupling method greatly improves the reliability of the control of the function control circuit 5. In comparison with the high voltage function control circuit for prior art neon lamps, the function control circuit 5 greatly reduces the manufacturing cost of the neon lamp control circuit, improves its reliability, prohibits the occurrence of high surge current, eliminates circuit stress, and achieves a high insulative effect. The oscillator 6 is comprised of IC1;R2;C8, and operated to produce a high frequency pulse signal. The exciting circuit 7 is comprised of IC1;R3;C9;B1;R4;R5;R7;R8, and controlled to provide a two-way reverse phase signal. The high frequency switch 9 is an excited semi-bridge circuit comprised of G1;G2;C10;C11;R9;R10;R6;B2. This high frequency switch design is stable, and can be conveniently controlled. Because metal-oxide-semiconductor field effect transistors are used, the switching efficiency of the high frequency switch 9 is greatly improved. The output circuit 10 is comprised of B2. The protective circuit 8 is comprised of R10;R11;R12;C12;CR1;R13; D9. Upon an overcurrent, the protective circuit 8 immediately cuts off power supply from the oscillator 6, so as to stop voltage output.

The operation of the neon lamp control circuit is outlined hereinafter with reference to FIGS. 2 and 3. The power input circuit 1, the EMI eliminator circuit 2, the rectifier circuit 3 and the power factor compensation circuit 4 form a power supply circuit, which changes AC220V or AC110V to a DC voltage. The DC voltage is then shunt through R1;W1;C7 into about a DC1-2V working voltage. The working voltage thus obtained is provided to the function control circuit 5, the oscillator 6, the exciting circuit 7 and the protective circuit 8.

When the function control panel outputs a high potential signal "1", it is transmitted to pins 1 and 2 of G01, thereby causing pin 3 of G01 to output a low potential signal "0". On the contrary, When the function control panel outputs a low potential signal "0", pin 3 of G01 is driven to output a high potential signal "1". The output signal from pin 3 of G01 is then transmitted to pin 11 of IC1 through D10, causing pin 10 of IC1 to output a reversed signal to control the oscillator, which is formed of IC1;C8;R2. When the function control panel outputs a high potential signal "1", the oscillator is driven output high frequency signal. On the contrary, when the unction control panel outputs a low potential signal "0", the oscillator does no work. Upon receipt of a high frequency signal by the oscillator, pins 2, 4 and 6 of IC1 output a reversed phase signal to the frequency compensation circuit, which is formed of R3;C9, enabling its frequency characteristics to be improved. The output signal from IC1 is then transmitted to an insulating transformer B1, causing the primary and secondary ends of the insulating transformer B1 to output high frequency signals of reversed phase and equal amplitude value to drive the metal-oxide-semiconductor field effect transistors G1;G2, causing G1;G2 to be alternatively turned on/off. When G1;G2 are alternatively turned on/off, a high frequency square wave signal is produced at the primary end of the booster transformer B2, causing the secondary end of the booster transformer B2 to output a component high frequency square wave to the conductive coating layer of the neon lamp tube, therefore a static electric field is produced inside the neon lamp tube to ionize the inert gas. When the inert gas is ionized, the fluorescent material inside the neon lamp tube is stricken to emit light.

When electric current is increased at G1;G2 due an overload or an abnormality of the circuit, the sampling voltage at R10 is relatively increased. When the value of the electric current surpasses the grid electrode voltage of SCR1, namely, 0.7V, SCR1 is turned on to output a low voltage through its anode electrode. The low voltage from SCR1 is transmitted through D9 to pin 9 of IC1, causing the oscillator to stop working, and therefore output voltage is cut off. When returning the circuit to normal operation, AC power supply must be cut off before examining the circuit and the load.

Figure 4:
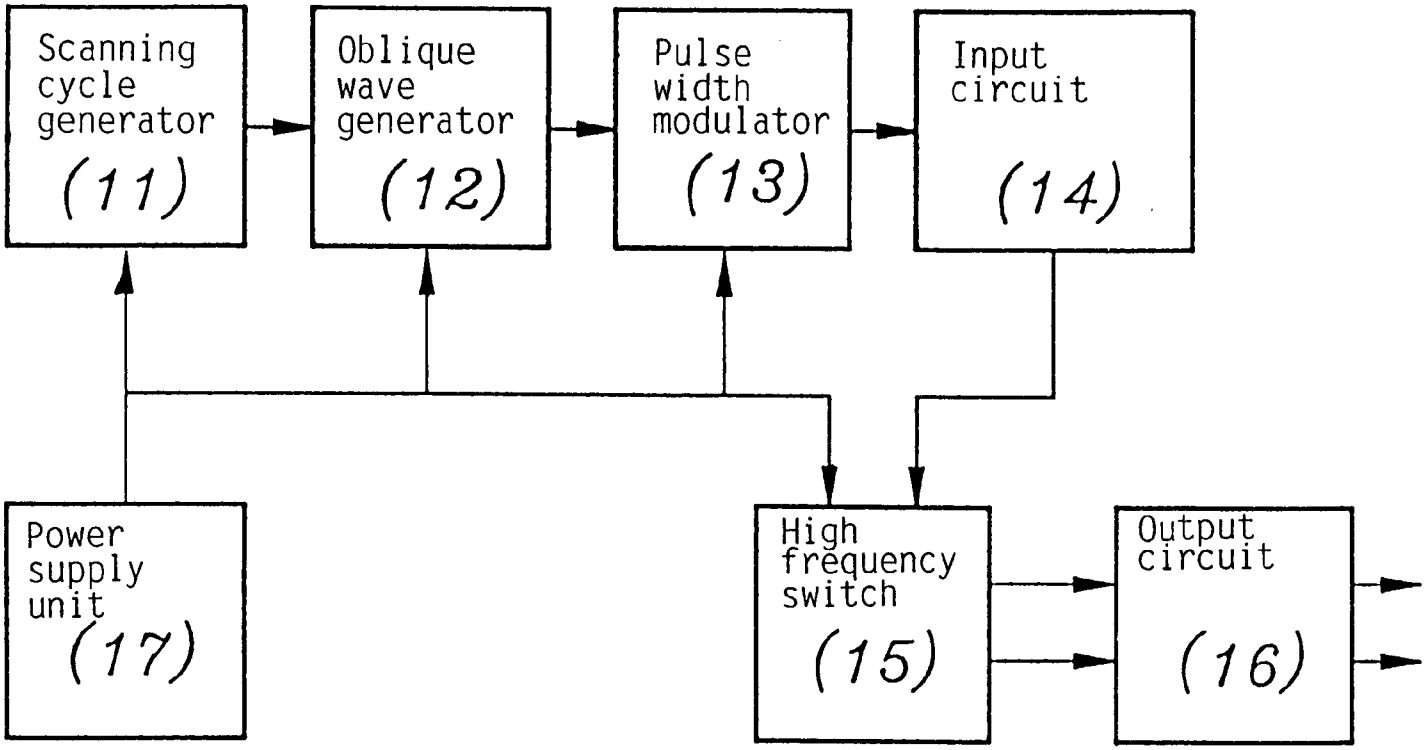
FIG. 4 is a circuit block diagram of a pulse width modulation and scanning control circuit according to the present invention.
Figure 5:
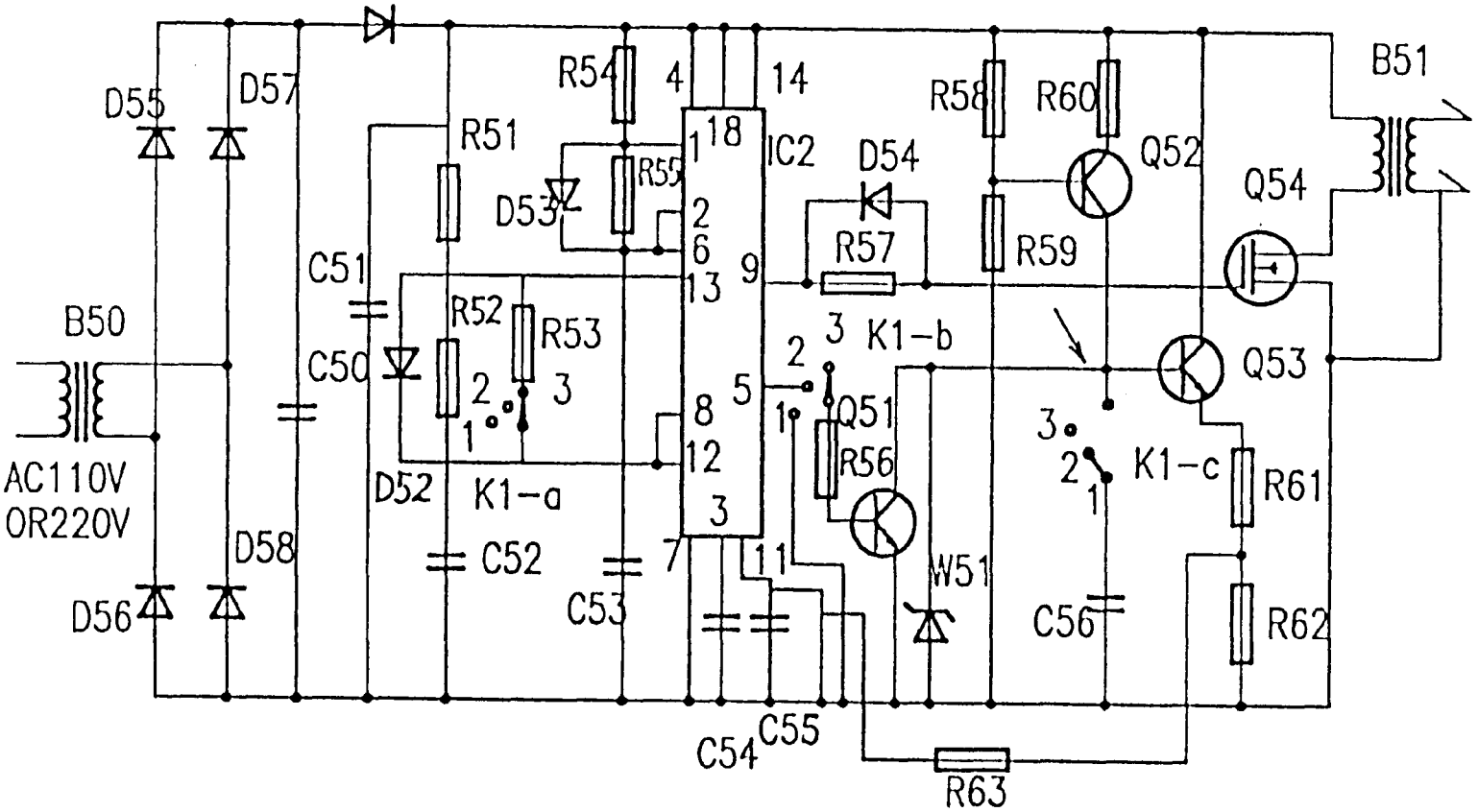
FIG. 5 is a circuit diagram of the pulse width modulation and scanning control circuit shown in FIG. 4.

A pulse width modulation and scanning control circuit in accordance with the present invention, as shown in FIGS. 4 and 5 (FIG. 4 is a circuit block diagram of the pulse width modulating and scanning control circuit; FIG. 5 is a detailed circuit diagram of the pulse width modulation and scanning control circuit) is generally comprised of a scanning cycle generator 11, an oblique wave generator 12, a pulse width modulator 13, an input circuit 14, a high frequency switch 15, an output circuit 16, and a power supply unit 17.

The scanning cycle generator 11 is comprised of IC2;R51;R52;R53;D52;C52, and controlled to generate the desired scanning cycle and reversing time signal. The reversing time is changeable through R51. The scanning cycle is changeable through R52;R53. C52 can be operated to adjust the reversing time as well as the scanning time. The oblique wave generator 12 is comprised of R56;R57;R58;R59;R60;R61;R62;W51;Q51;Q52; Q53;C56. Q52;R57;R58;R59;C56 form a constant current charging circuit. W51 controls the maximum pulse width. C56 produces an oblique wave voltage of good linearity to control the pulse width modulator 13. The pulse width modulator 13 is comprised of IC2;R54;R55;D53;C53;C55. The pulse signal which comes from the oblique wave generator 12 and modulated by the pulse width modulator 13 is then sent through the input circuit 14, which is comprised of D54;R57, to excite the high frequency switch 15, thereby causing the output circuit 16 to output a high frequency pulse signal to the neon lamp tube, and therefore the neon lamp is driven to emit light. The high frequency switch is formed of metal-oxide-semiconductor field effect transistors for the advantage of good switching characteristics. The variation of pulse width achieves the scanning function of the neon lamp tube. The circuit is controlled by switching to provide three function status: (1) normal lighting, (2) scanning function, and (3) flashing function. The power supply unit 17 can be a DC power supply device, or an AC adapter which rectifies AC power supply into the desired voltage level.

The scanning cycle generator 11 which is comprised of IC2;R51;R52;R53;D52;C52 provides an adjustable square wave signal through pin 5 of IC, switch K1-b and R56 to control opening/closing of Q51, so as to further control charging/discharging of C56. When pin 5 of IC2 outputs a low voltage, Q51 is off, a constant current from a constant current source, which is formed of Q52;R60;R58;R59, is provided to K1-C, causing it to charge C56. When C56 is charged, the base of Q53 obtains an oblique wave voltage, thereby causing the emitter of Q53 to output a voltage, enabling the voltage to be shunt by R62;R51, and then sent to pin 11 of IC2. IC2;R54;R55; D53;C53;C55;R62 form a pressure control oscillator. When the control voltage is changed within a limited range, the variation of electric induction of C53 (i.e., pulse width variation) during charging time is greater than that during discharging time. Therefore, when the voltage linearity of pin 11 of IC2 is changed, pin 9 of IC2 outputs a pulse width variable pulse signal to the grid electrode of switching transistor Q54 via the input circuit, causing Q54 to be turned on/off, and therefore a high frequency high voltage pulse width variable pulse signal is given to the transparent conductive coating layer of the glass tube of the neon lamp. When a high frequency high voltage pulse width variable pulse signal is given to the transparent conductive coating layer of the glass tube of the neon lamp, a static electric field with a variable linearity is produced inside the neon lamp tube to ionize the inert gas, causing the fluorescent material inside the neon lamp tube to be stricken to emit light. Because the linearity of the static electric field is variable, the linearity of the area where the inert gas is ionized is variable, therefore the lighting length of the neon lamp tube varies with the pulse width.

As indicated above, the present invention controls the scanning function of the neon lamp by means of weak signal, and decides the initial scanning point of the neon lamp by changing the arrangement of the transparent conductive coating layer on the glass tube of the neon lamp.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A high field effect neon lamp comprising a glass tube having at least one section of an outside wall thereof coated with a transparent conductive layer, a pulse width modulation and scanning control circuit connected to said transparent conductive layer, said pulse width modulation and scanning control circuit being controlled to give a high frequency high voltage pulse width variable pulse signal to said transparent conductive coating layer, causing a linearity-variable static electric field to be produced in said glass tube, so that an inert gas in said glass tube is ionized to strike a fluorescent material on an inside wall of said glass tube, causing it to emit light, wherein said pulse width modulation and scanning control circuit is comprised of a scanning cycle generator, an oblique wave generator, a pulse width modulator, an input circuit, a high frequency switch, an output circuit, and a power supply unit, said scanning cycle generator being operated to adjust the reversing time and scanning time of the neon lamp, said oblique wave generator being controlled to provide a pulse signal, said pulse width modulator being controlled to modulate the pulse width of the pulse signal from said oblique wave generator, enabling the modulated pulse signal to excite said high frequency switch, causing said output circuit to output a high frequency pulse signal to said transparent conductive layer so as to ionize said inert gas in said glass tube in striking said fluorescent material.

2. The high field effect neon lamp as claimed in claim 1, further comprising an oscillator controlled by an external function control panel to output a high frequency signal to a transformer connected thereto, causing a secondary end of said transformer to output a component high frequency square wave to said transparent conductive layer of said glass tube, so that a static electric field is produced inside said glass tube to ionize the inert gas in striking the fluorescent material to emit light.

3. The high field effect neon lamp as claimed in claim 1, wherein said transparent conductive layer is spray-coated on separated sections of the outside wall of said glass tube, and both ends of the transparent conductive layer at every section of the outside wall of said glass tube are respectively connected to said pulse width modulation and scanning control circuit to provide multiple scanning points.

* * * * *